US008635848B2

(12) United States Patent
Mackey et al.

(10) Patent No.: US 8,635,848 B2
(45) Date of Patent: Jan. 28, 2014

(54) METHOD AND APPARATUS FOR PREVENTING STRANDING ELEMENTS FROM CROSSING DURING A STRANDING PROCESS

(75) Inventors: Barber Mackey, Greenville, SC (US); Brett Villiger, Simpsonville, SC (US); Chris Morris, Spartanburg, SC (US)

(73) Assignee: AFL Telecommunications LLC, Spartanburg, SC (US)

( * ) Notice: Subject to any disclaimer, the term of this patent is extended or adjusted under 35 U.S.C. 154(b) by 0 days.

(21) Appl. No.: 13/574,540

(22) PCT Filed: Jan. 20, 2012

(86) PCT No.: PCT/US2012/022025

§ 371 (c)(1),
(2), (4) Date: Jul. 20, 2012

(87) PCT Pub. No.: WO2012/100160

PCT Pub. Date: Jul. 26, 2012

(65) Prior Publication Data

US 2012/0291414 A1 Nov. 22, 2012

Related U.S. Application Data

(60) Provisional application No. 61/434,898, filed on Jan. 21, 2011.

(51) Int. Cl.
*D01H 13/00* (2006.01)

(52) U.S. Cl.
USPC ..... 57/311

(58) Field of Classification Search
USPC ..... 57/58.36, 58.7, 58.83, 311, 314, 352, 57/354
See application file for complete search history.

(56) References Cited

U.S. PATENT DOCUMENTS

| | | | | |
|---|---|---|---|---|
| 1,671,951 | A | 5/1928 | Angell | |
| 1,899,559 | A | 2/1933 | Damon | |
| 2,497,178 | A * | 2/1950 | McNamee | 57/311 |
| 2,556,164 | A * | 6/1951 | Carleton et al. | 57/9 |
| 2,724,944 | A * | 11/1955 | Carleton et al. | 57/311 |
| 3,396,522 | A * | 8/1968 | Biagini | 57/15 |
| 3,446,000 | A * | 5/1969 | Smollinger et al. | 57/138 |
| 3,559,390 | A | 2/1971 | Staschewski | |
| 4,087,956 | A * | 5/1978 | Gre | 57/58.54 |
| 4,369,619 | A | 1/1983 | Nielsen et al. | |
| 4,388,799 | A * | 6/1983 | Vives | 242/439.5 |
| 4,641,492 | A * | 2/1987 | Glushko et al. | 57/9 |
| 4,663,926 | A * | 5/1987 | Girardon et al. | 57/6 |
| 6,851,293 | B2 * | 2/2005 | Begin et al. | 72/43 |
| 2007/0125488 | A1 | 6/2007 | Brisson et al. | |

OTHER PUBLICATIONS

International Search Report, PCT/US2012/022025, filed May 1, 2012.

* cited by examiner

*Primary Examiner* — Shaun R Hurley
(74) *Attorney, Agent, or Firm* — Sughrue Mion, PLLC

(57) ABSTRACT

A stranding apparatus including a preformer attached to a preformer shaft; an adjustable core guide attached to the preformer shaft; and a ring positioned away from the preformer and centered on a longitudinal axis of the preformer shaft; wherein a gap is formed between the ring and the adjustable core guide, through which a stranding element can pass.

10 Claims, 5 Drawing Sheets

METHOD AND APPARATUS FOR PREVENTING STRANDING ELEMENTS FROM CROSSING DURING A STRANDING PROCESS

CROSS-REFERENCE TO RELATED APPLICATIONS

This application is based upon and claims the benefit of priority from U.S. Provisional Application No. 61/434,898, filed Jan. 21, 2011 in the United States Patent and Trademark Office, the disclosure of which is incorporated herein in its entirety by reference.

BACKGROUND

1. Field

The invention is related to an apparatus and method for preventing stranding elements from crossing during a stranding process.

2. Related Art

Wire stranding is a very common process in the cable and wire rope industry. However, a wire cross is a frequent quality issue in the wire stranding process. A wire cross occurs when one or more wires cross each other in a cable or wire rope. The wire cross is undesirable because this defect causes a diameter variation, stress point, and/or defect point in the cable or wire rope. An example of a wire cross is shown in FIG. 1.

An object of this invention is to develop an apparatus and method for preventing wire crosses.

SUMMARY

Exemplary implementations of the present invention address at least the above problems and/or disadvantages and other disadvantages not described above. Also, the present invention is not required to overcome the disadvantages described above, and an exemplary implementation of the present invention may not overcome any of the problems listed above.

A first embodiment of the invention is a stranding apparatus that includes a preformer attached to a preformer shaft; an adjustable core guide attached to the preformer shaft; and a ring positioned away from the preformer and centered on a longitudinal axis of the preformer shaft; wherein a gap is formed between the ring and the adjustable core guide, through which a stranding element can pass.

In the stranding apparatus, the core guide can be positioned between the preformer and the ring.

In the stranding apparatus, the core guide can include a disk.

In the stranding apparatus, the adjustable core guide can be positioned such that a thickness of the gap is set such that crossing of the stranding element is prevented, wherein the thickness is defined as the width of an opening between the adjustable core guide and the ring that runs parallel to the stranding element.

In the stranding apparatus, the gap can be less than twice a diameter of the stranding element.

The invention is also a method of stranding that includes feeding a stranding element through a preformer attached to a preformer shaft; attaching the stranding element to a core; positioning the preformer such that the stranding elements become taut and are positioned close to an inner surface of a ring positioned away from the preformer, wherein the ring is centered on a longitudinal axis of the preformer shaft; positioning an adjustable core guide attached to the preformer shaft wherein a gap is formed between the ring and the adjustable core guide, through which the stranding element passes; and performing a stranding process.

In the method, the core guide can be positioned between the preformer and the ring.

In the method, the core guide can include a disk.

In the method, the adjustable core guide can be positioned such that a thickness of the gap is set such that crossing of the stranding element is prevented, wherein the thickness is defined as the width of an opening between the adjustable core guide and the ring that runs parallel to the stranding element.

In the method, the gap can be less than twice a diameter of the stranding element.

DETAILED DESCRIPTION

Figure 1:
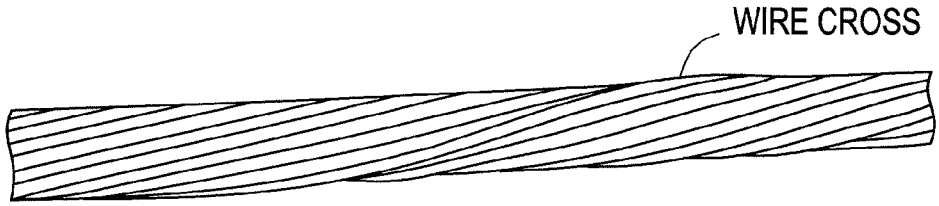
FIG. 1 is a diagram of an example of a wire cross.
Figure 2:
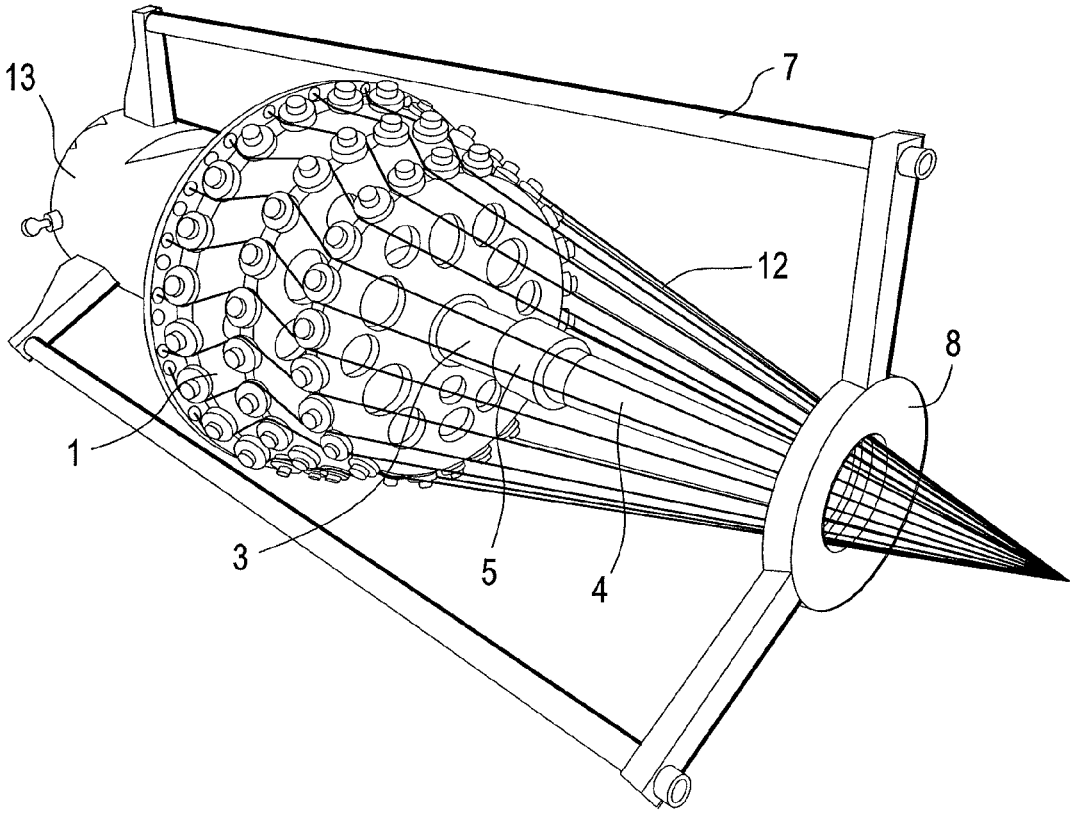
FIG. 2 is a view of an embodiment of a preformer apparatus.
Figure 3:
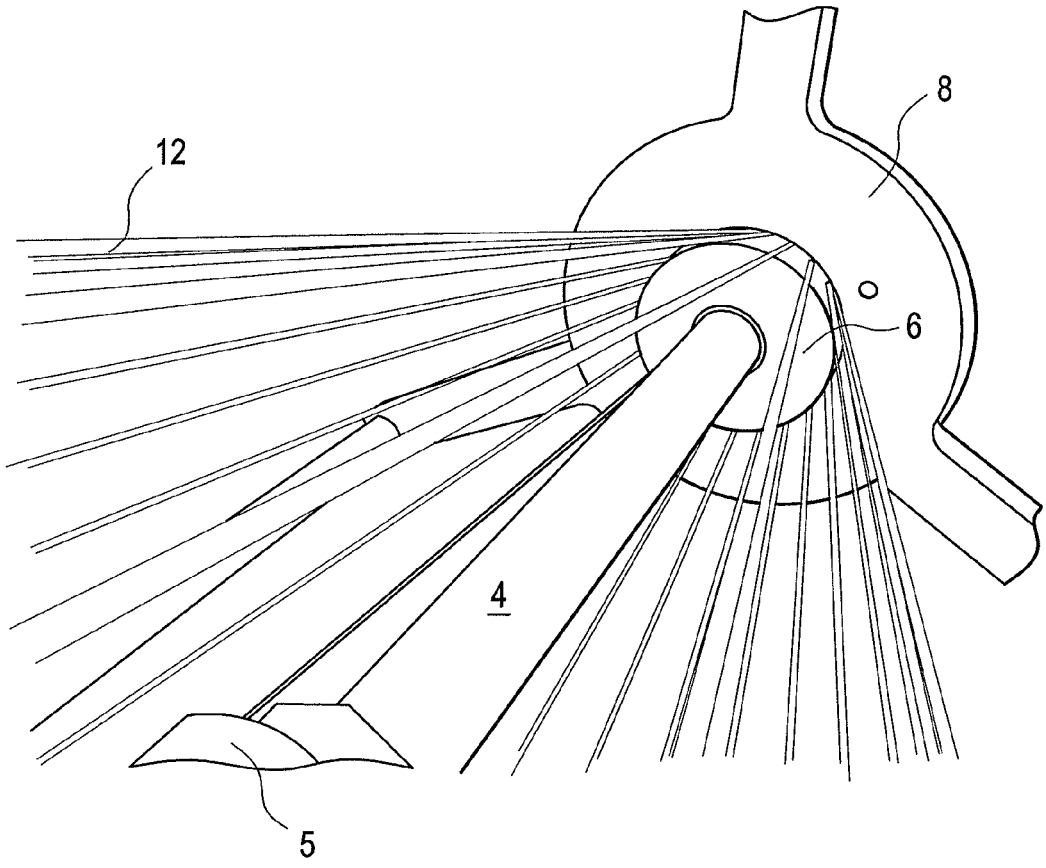
FIG. 3 is a view showing a close-up of an embodiment of a preformer apparatus.
Figure 4:
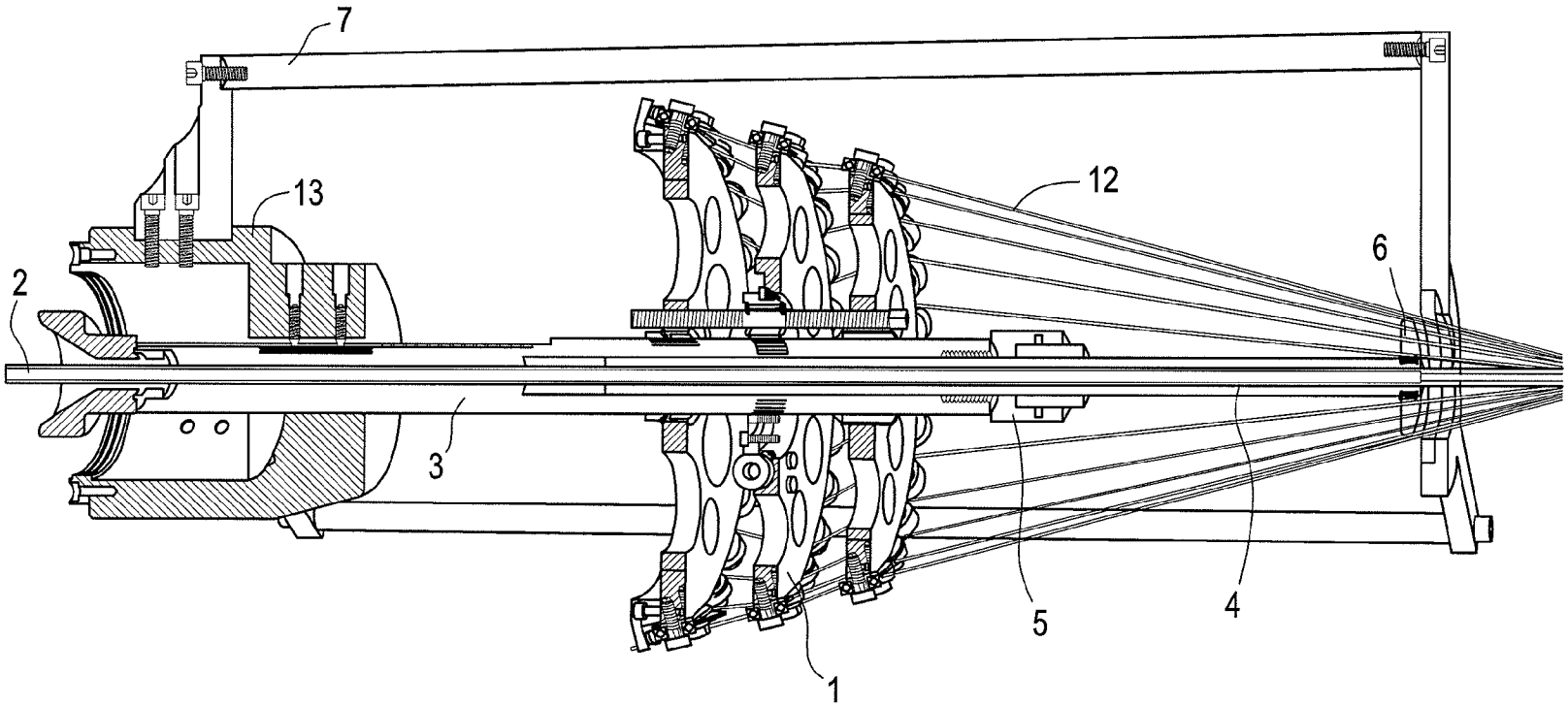
FIG. 4 is a cross-section view of an embodiment of a preformer apparatus.

The following detailed description is provided to assist the reader in gaining a comprehensive understanding of the methods, apparatuses and/or systems described herein. Various changes, modifications, and equivalents of the systems, apparatuses and/or methods described herein will suggest themselves to those of ordinary skill in the art. Descriptions of well-known functions and structures are omitted to enhance clarity and conciseness.

Hereinafter, the exemplary embodiments will be described with reference to accompanying drawings.

FIGS. 2-6 show various views of an embodiment of the invention. The embodiment includes a preformer 1 mounted on a preformer shaft 3. The preformer shaft 3 is mounted in the preformer support 13. The preformer shaft 3 can be extended or retracted within the preformer support 13 to adjust the distance between the preformer 1 and a ring 8. The preformer shaft 3 has an opening along its axis so that a core 2 can pass through the preformer shaft 3. The core 2 is the structure that will be covered by the stranding elements, such as wire strands 12. The core can be many different items. For example, it could be a metal rod, a cable, a stainless steel tube, etc.

A preformer ring support 7 includes an opening 10 through which the core 2 and wire strands 12 pass. The opening is formed by a ring 8. The ring 8 is positioned away from the preformer 1 and is centered on the longitudinal axis 14 of the preformer shaft 3. The ring can be made of many different materials, including ceramic, ferrous and non-ferrous materials. In one embodiment, the diameter of the opening 10 is 2.25 inches. However, other diameters could be used.

Also attached to the preformer shaft 3 is an adjustable core guide/wire cross prevention shaft 4; hereinafter called the adjustable core guide. At one end of the adjustable core guide 4 is a disk 6. At the other end is an attachment mechanism 5, such as a chuck, that attaches the adjustable core guide 4 to the preformer shaft 3. The adjustable core guide 4 moves along the axis of the preformer shaft 3, which enables the disk 6 to be moved closer and farther away from the ring 8. In one embodiment, the diameter of the disk 6 is 2.25 inches. However, other diameters could be used. The adjustable core guide/wire cross prevention shaft 4 also has an opening along its axis so that the core 2 can pass through it.

Next, the operation of the preforming apparatus will be described. After the wire strands 12 are feed through the preformer 1 and passed through the opening 10, they are attached to the core 2. Next, the preformer 1 is positioned by means of the preformer shaft 3 in preformer support 13 such that the wire strands become taut and are positioned close to the inner surface of the ring 8. Ideally, the wire strands 12 should be in contact, or nearly in contact, with the ring 8, but not be deflected by the ring (i.e., the wire strands 12 should form a straight line from the preformer 1 to the core 2).

After the preformer 1 is locked in place by means of the preformer shaft 3 in preformer support 13, the adjustable core guide 4 is positioned along the preformer shaft 3 until the outer diameter of the disk 6 is positioned close to the wire strands 12. Ideally, the wire strands 12 should be in contact, or nearly in contact, with the disk 6, but not be deflected by the disk 6 (i.e., the wire strands 12 should form a straight line from the preformer 1 to the core 2). The adjustable core guide 4 is then locked in place on the preformer shaft 3.

Figure 5:
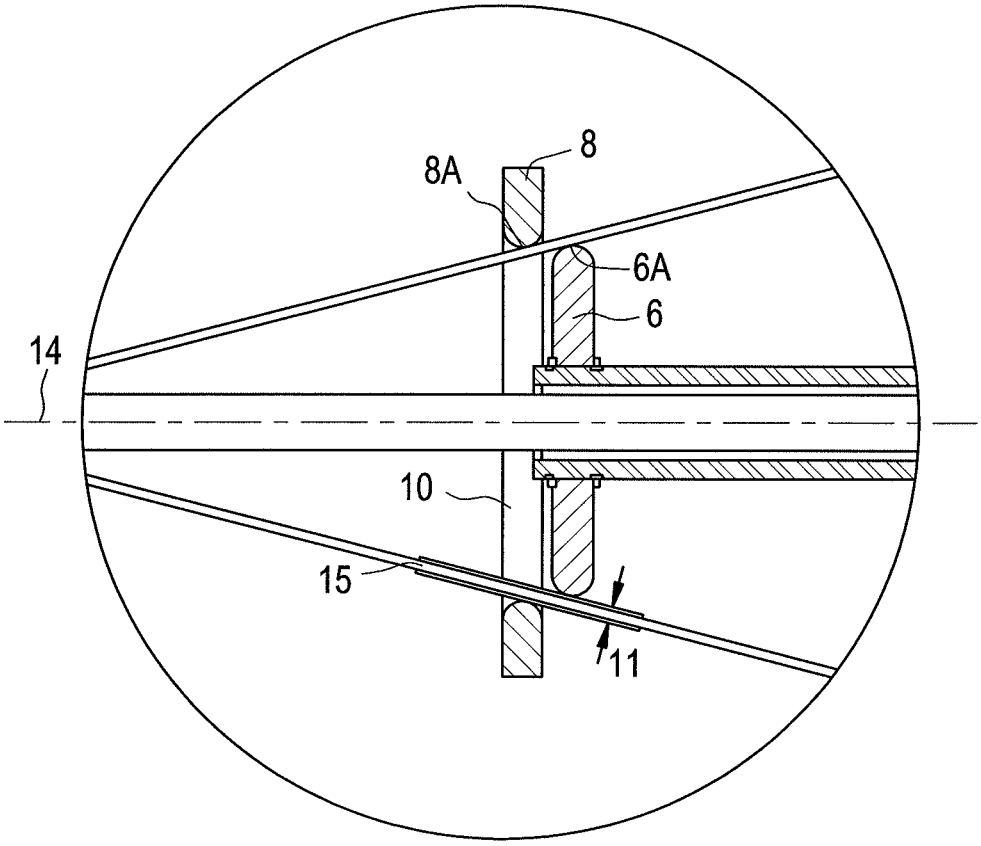
FIG. 5 is a close-up cross-section view of an embodiment of the invention.
Figure 6:
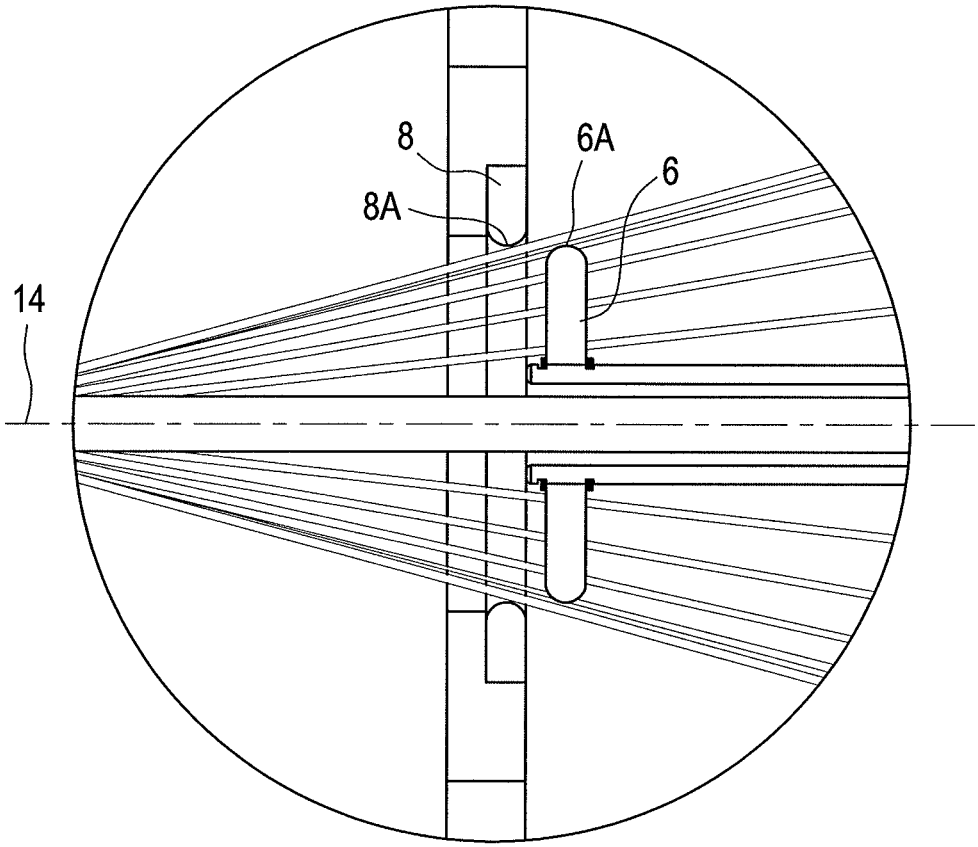
FIG. 6 is a close-up cross-section view of an embodiment of the invention.

When both the preformer 1 and adjustable core guide 4 has been properly positioned along the preformer shaft a gap 11 is formed between the outer surface 6A of disk 6 and the inner surface 8A of the ring 8. The gap 11 should be set such that wire cross conditions will not occur during the stranding process. The gap 11 is defined as the width of an opening 15 that runs parallel to the wire strands 12 as shown in FIG. 5. Ideally, the width of the gap 11 should be the diameter of the wire strands 12; however, a gap that is less than twice the diameter of the wire strands 12 would also work. Other gaps that are equal to or larger than twice the diameter of the wire strands that would also prevent cross wires may also be used.

After all elements have been set, a conventional wire stranding process can begin.

As mentioned above, although the exemplary embodiments described above are directed to the stranding of wires, this is merely exemplary and the general inventive concept should not be limited thereto, and it could also apply to the stranding of other stranding elements, such as cable, optical fibers, or other materials that can be wound. In addition, while the embodiment shown shows that the ring 8 is fixed relative to the preformer 1 and adjustable core guide 4, one or more of these three elements could be fixed or movable, as long as an appropriate gap can be formed.

What is claimed:

1. A stranding apparatus comprising:

a preformer attached to a preformer shaft;

an axially adjustable core guide attached to said preformer shaft; and a ring positioned away from said preformer and centered on a longitudinal axis of said preformer shaft;

wherein a gap is formed between said ring and said axially adjustable core guide, through which a stranding element can pass.

2. The stranding apparatus of claim 1 wherein said core guide is positioned between said preformer and said ring.

3. The stranding apparatus of claim 1 wherein said core guide comprises a disk.

4. The stranding apparatus of claim 1 wherein said axially adjustable core guide can be positioned such that a thickness of said gap is set such that crossing of said stranding element is prevented, wherein said thickness is defined as the width of an opening between said axially adjustable core guide and said ring that runs parallel to said stranding element.

5. The stranding apparatus of claim 4 wherein said gap is less than twice a diameter of said stranding element.

6. A method of stranding comprising:

feeding a stranding element through a preformer attached to a preformer shaft; attaching said stranding element to a core;

positioning said preformer such that said stranding element becomes taut and is positioned close to an inner surface of a ring positioned away from said preformer, wherein said ring is centered on a longitudinal axis of said preformer shaft;

positioning an axially adjustable core guide attached to said preformer shaft wherein a gap is formed between said ring and said axially adjustable core guide, through which the stranding element passes; and performing a stranding process.

7. The stranding method of claim 6 wherein said core guide is positioned between said preformer and said ring.

8. The stranding method of claim 6 wherein said core guide comprises a disk.

9. The stranding method of claim 6 wherein said axially adjustable core guide is positioned such that a thickness of said gap is set such that crossing of said stranding element is prevented, wherein said thickness is defined as the width of an opening between said a axially adjustable core guide and said ring that runs parallel to said stranding element.

10. The stranding method of claim 9 wherein said gap is less than twice a diameter of said stranding element.

* * * * *